US005538515A

United States Patent [19]

Kafry et al.

[11] Patent Number: 5,538,515

[45] Date of Patent: Jul. 23, 1996

[54] METHOD FOR MAKING A RANDOMLY FADED FABRIC

[75] Inventors: Mordechai Kafry; Charlton R. Davidson, both of Honk Kong, Hong Kong

[73] Assignee: Sentani Trading Ltd., Kowloon, Hong Kong

[21] Appl. No.: 215,996

[22] Filed: Mar. 22, 1994

[51] Int. Cl.[6] ..... D06L 3/02; D06L 3/08

[52] U.S. Cl. ..... 8/107; 8/102; 8/108.1; 8/110; 8/111

[58] Field of Search ..... 8/102, 107, 108.1, 8/111, 110; 252/94, 95

[56] References Cited

U.S. PATENT DOCUMENTS

| | | | |
|---|---|---|---|
| 2,788,297 | 4/1957 | Louis | 117/211 |
| 4,218,220 | 8/1980 | Kappler et al. | 8/102 |
| 4,575,887 | 3/1986 | Viramontes | 8/158 |
| 4,740,213 | 4/1988 | Ricci | 8/108.1 |
| 4,852,990 | 8/1989 | Patterson | 8/108.1 |
| 4,900,323 | 2/1990 | Dickson et al. | 8/111 |
| 4,919,842 | 4/1990 | Dickson et al. | 252/186.43 |
| 5,114,426 | 5/1992 | Milora et al. | 8/102 |
| 5,190,562 | 3/1993 | Dickson et al. | 8/111 |
| 5,218,791 | 6/1993 | Parent et al. | 51/319 |

FOREIGN PATENT DOCUMENTS

| | | |
|---|---|---|
| 275432 | 7/1988 | European Pat. Off. . |
| 842224 | 7/1960 | United Kingdom . |

*Primary Examiner*—Prince Willis, Jr.
*Assistant Examiner*—Alan D. Diamond
*Attorney, Agent, or Firm*—Panitch Schwarz Jacobs & Nadel

[57] ABSTRACT

A hammering body having a plurality of protrusions on its external surface useful for randomly fading fabric and a method for randomly fading fabric are provided. The method comprising the steps of providing an at least partially wet fabric to be faded, at least one hammering body having an external surface with a plurality of protrusions, and a powder comprising a bleaching agent to a tumbling chamber, tumbling the fabric, the hammering body and the powder in the chamber such that the protrusions of the hammering body repeatedly strike the fabric, thereby driving the powder into the fabric until a desired fading effect is achieved, and separating the faded fabric from the hammering body.

16 Claims, 2 Drawing Sheets

METHOD FOR MAKING A RANDOMLY FADED FABRIC

FIELD OF THE INVENTION

The present invention relates to a method for randomly fading fabric, particularly denim and to hammering bodies useful in random fabric fading methods. Specifically, this invention relates to a method for randomly fading fabric which minimizes the disadvantages of those processes which use pumice and surface abrasion to produce a randomly faded effect.

BACKGROUND OF THE INVENTION

Random fading to provide a "stone-washed" or worn appearance is a highly popular fabric treatment in the clothing industry, particularly for denim fabric. Such fading is generally accomplished by means of bleaching the denim fabric, abrading the fabric by natural stones such as pumice, or bleaching the fabric in addition to fabric abrasion. The bleaching agent may be contacted to the fabric by either aqueous washing methods or by dry tumbling methods.

In the past, this worn appearance was provided merely by washing denim with pumice stone. Pumice, or lava rock, is porous and tends to abrade the fabric upon contact. Pumice and other similar natural rocks used in random fading processes break apart and tend to form sharp pieces which may tear garments or cause damage to the interior surface of processing equipment. Further, pumice, as it deteriorates during processing, forms sand and small rock pieces which are not easily separable from the treated garments. Typically, in garments treated by pumice, sand remains in the seams, pockets and other closed areas. In dryer tumbling methods using pumice, the drying chamber requires holes to remove the sand and broken rock pieces. Sand in the garment is a highly undesirable by-product of a pumice-based process as it acts as a skin irritant for a significant number of people wearing the treated fabric.

Subsequently developed methods, such as that of U.S. Pat. No. 4,720,213 for treating denim with abrasive stones impregnated with bleaching agents, provide an enhanced worn appearance over merely washing the fabric with abrasive stones. However, these processes retain the same disadvantages of other stone processes, including unwanted sand and fabric damage.

As a result of the disadvantages of using pumice stone, the clothing industry has attempted to develop a process which can economically achieve a similar or improved worn, randomly faded appearance such as that derived from existing pumice stone methods, but which does not create unwanted sand or damage the fabric.

SUMMARY OF THE INVENTION

The present invention provides a method for randomly fading fabric. The method comprises providing fabric which is at least partially wet along with one or more hammering bodies and a powder comprising a bleaching agent to a tumbling chamber. The hammering body has an external surface which has a plurality of protrusions. The fabric, hammering body and powder are tumbled in the chamber such that the protrusions of the hammering body repeatedly strike the fabric. The protrusions of the body drive the powder into the fabric. The tumbling continues until a desired fading effect is achieved. After tumbling, the randomly faded fabric is separated from the hammering body.

The resulting fabric is randomly faded, but the surface of the fabric is not abraded by the hammering body thereby increasing the ability of the fabric to resist wear. Wear resistance extends the useful life of the garment which represents savings to the fabric consumer.

The present invention also includes a hammering body useful for randomly fading fabric. The body comprises a generally spherical base and a plurality of hammer-like protrusions each having a face. The protrusions are spaced across and extend outwardly from the external surface of the base. The face of each protrusion is configured to hammer a powdered bleaching agent into a fabric to be faded when the body is tumbled with the fabric and the bleaching agent.

BRIEF DESCRIPTION OF THE DRAWINGS

The foregoing summary, as well as the following detailed description of the preferred embodiment of the invention, will be better understood when read in conjunction with the appended drawings. In the drawings, like numerals are used to indicate like elements throughout. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF PREFERRED EMBODIMENTS

The method of the present invention may be used to provide a randomly faded look to many natural, synthetic or blended fabrics, including cotton, cotton/polyester blends, crepe, silk and rayon and any other fabric which is sensitive to chemical bleaching agents or which has been developed with a dye adapted for random fading. Preferably, the fabric to be used in the present method is denim.

The method may be practiced on unassembled fabric or on articles constructed from fabric including items such as jeans, skirts, shirts, jackets, hats, purses and related articles whether or not intended as wearing apparel.

Figure 4:
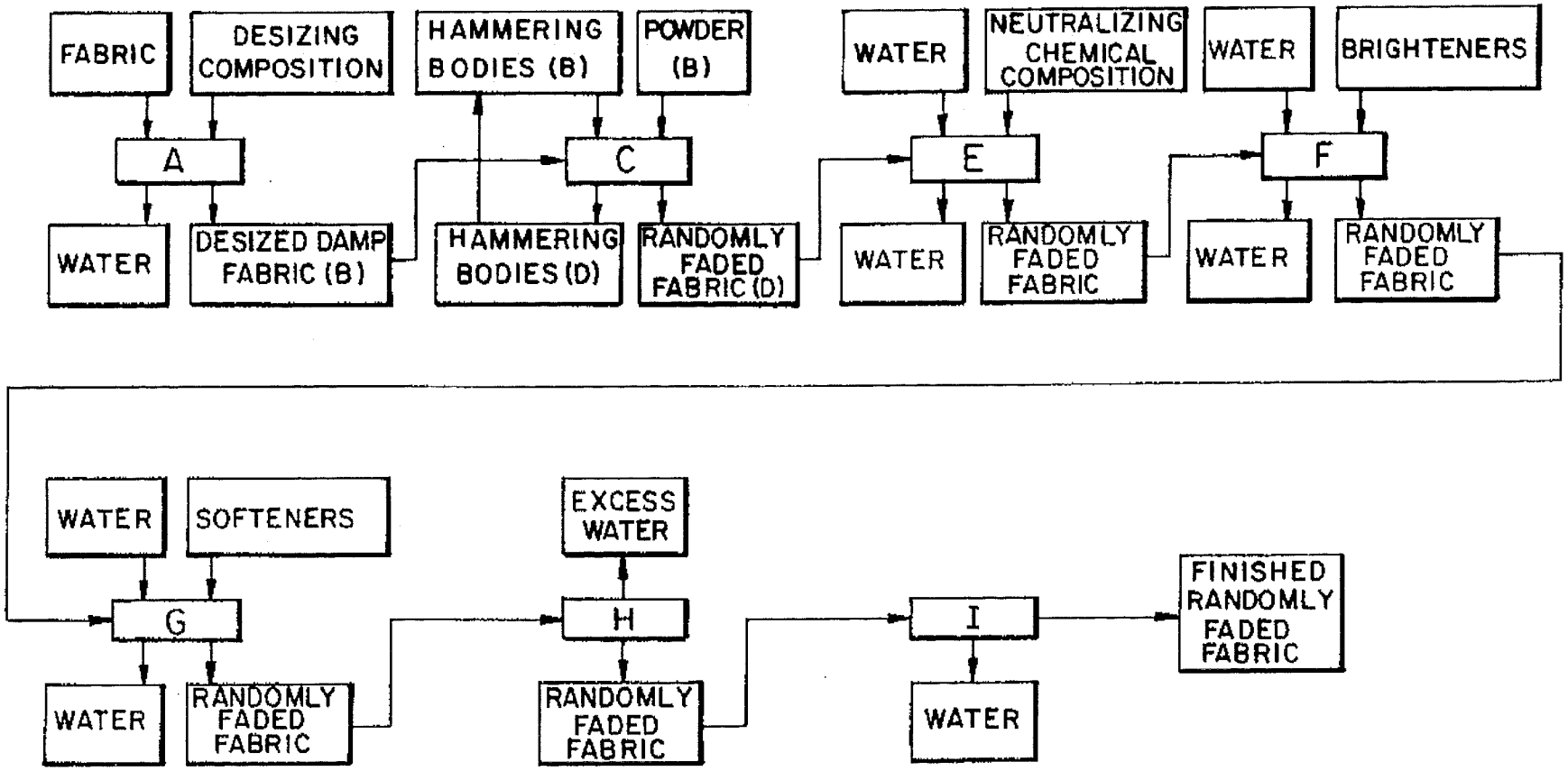
FIG. 4 is a block diagrammatic representation of the steps of a preferred embodiment of the method of the present invention.

The basic steps of the preferred method are shown in block diagrammatic form in FIG. 4. As shown in FIG. 4, the preferred steps of the present method generally include (A) desizing of the fabric, (B) providing the fabric, one or more hammering bodies and a powder comprising a bleaching agent to a tumbling chamber, (C) tumbling the fabric with the bodies and the powder, (D) separating the fabric from the bodies, (E) neutralizing the bleaching agent, (F) brightening and (G) softening the fabric, and (H) spinning and (I) drying the fabric. Steps B, C and D constitute the essential steps of the present method. Steps B, C and D together with optional steps, A, E, F, G, H and I, constitute the preferred embodiment of the method.

In step A, the fabric (not shown) to be faded is preferably first "desized." Desizing consists of destroying existing enzymes and otherwise removing any finishing compounds placed on commercially available fabric during manufacture such as, for example, starch, gelatin, oil, wax, polyvinyl alcohol, polystyrene, polyacrylic acid, polyacetates and other similar sizing materials. Desizing helps to enhance and accelerate the bleaching effect which is provided in step C by the hammering bodies and bleaching powder by eliminating finishing materials which may interfere with the reaction of the bleaching agent and the water in the fabric. Desizing may occur by any method known to those of ordinary skill in the art whether by washing or dry cleaning methods. In the preferred method, desizing occurs by machine washing the fabric in an industrial washing machine (not shown) with an aqueous solution comprising water and a desizing compound. The desizing step and other washing steps described below may be carried out in an industrial washing machine such as, for example, a Washex® 450 lb capacity washing machine. However, any industrial or household capacity washing machine or other equipment capable of retaining and agitating fabric with water may be used in the present method.

The desizing compound may be comprised of any available desizing compound known to those of ordinary skill in the art. A preferred commercially available compound suitable for desizing the fabric is the FADE'M® desizing composition made by Diversey Corporation, Chemicals Div., Wyandotte, Mich. It should be understood that the ingredients of the desizing compound may vary depending upon the type of fabric to be treated and any dyeing process which may be used on the finished fabric.

After desizing step A, the fabric is in a wet condition. Preferably, the fabric is spun dry after desizing to remove excess water so that the fabric is in a damp condition. The fabric may be spun dry while in the washing machine or in a separate spinning machine (not shown). In the preferred embodiment, the fabric is spun dry in a separate spinning machine to remove excess water, then dried in an industrial dryer (not shown) to a damp condition. A dryer useful for this purpose may be any household or industrial dryer, for example, a 450 lb capacity Melnor® industrial dryer. At least from about 80% to about 95% water is preferably removed from the fabric after desizing by spinning and drying.

The wet or damp fabric is then provided to a tumbling chamber (not shown) in step B. The tumbling chamber is preferably provided in place of the typical drum of an industrial dryer (not shown). Industrial washing machines may also be fitted with tumbling chambers and used in accordance with the present invention.

The chamber is preferably a substantially non-porous rotating drum having no perforations to prevent unwanted loss of water and a powdered bleaching agent which is also provided to the chamber during step B. The tumbling chamber useful for steps B and C of the present invention is preferably installed within an industrial washer or dryer and preferably has a load capacity of from about 200 lbs to about 450 lbs and a tumbling speed of from about 20 rpm to about 35 rpm. A tumbling chamber in accordance with the present invention may be provided to other similar pieces of equipment capable of tumbling fabric which may be substituted for the industrial dryer or washer described without departing from the scope of the present invention. In addition, a porous chamber may be used in the present invention; however, such a chamber is not recommended as the amount of powder added would have to be increased to compensate for loss of powder during tumbling thereby increasing the raw materials cost of the method. A porous chamber may also increase the risk of inconsistency in fabric color matching.

Figure 1:
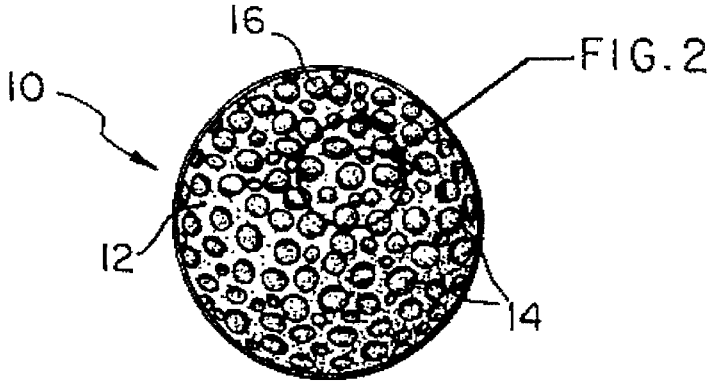
FIG. 1 is representation of a preferred embodiment of a hammering body in accordance with the present invention.
Figure 2:
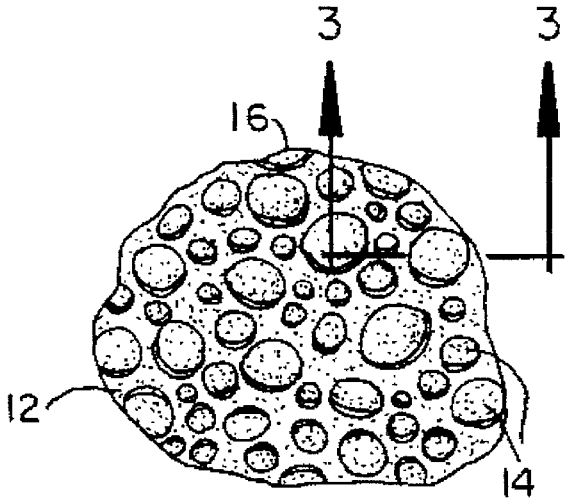
FIG. 2 is an enlarged top view of protrusions extending from the external surface of the body shown in FIG. 1.
Figure 3:
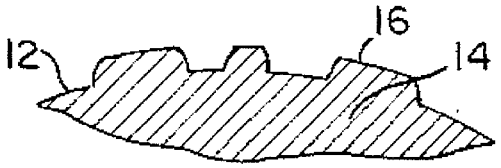
FIG. 3 is a cross-sectional elevational view of some of the protrusions of FIG. 2 taken along line 3—3.

Hammering bodies 10 such as the one depicted in FIGS. 1–3 are also provided to the tumbling chamber. The bodies 10 are preferably generally spherical in shape; however, the bodies 10 can also be generally egg-shaped, rectangular, triangular or of various other geometric shapes. Preferably the bodies 10 include a polymeric material. Treatment of certain fabrics may require heavier bodies 10 comprised of steel, or other similar metals or metal alloys which may or may not comprise a polymeric coating as an external surface 12. Typical polymeric materials which are suitable for making the bodies 10 include, for example, homopolymers, copolymers and terpolymers of vinyl chloride, acrylic or any other similar polymeric material having sufficient hardness to effect hammering. Preferably the bodies are made of polyvinyl chloride. It should be understood by one of ordinary skill in the art that other similar metallic or polymeric materials may be substituted in making the bodies 10 without departing from the scope of this invention.

The external surface 12 of a body 10 should preferably be substantially non-porous. More preferably, the external surface 12 should be free from any openings or pores and should be impervious. The size, shape, weight and materials forming the bodies 10 may be changed, providing a large number of possible combinations so as to produce variations in the random fading effect without departing from the scope of the invention as long as the body 10 is not constructed or shaped to significantly abrade or damage the fabric or to cause significant impact damage to the tumbling chamber. A body 10 may preferably be from about 1 cm to about 8 cm in diameter, and in the most preferred embodiment a body 10 is from about 2.5 cm to about 7.5 cm in diameter.

While the quantity of bodies 10 added to the tumbling chamber will vary depending upon the type and extent of the random fading effect desired and the weave and weight of the fabric, it is preferred that the bodies 10 are added in an amount comprising from about 10% to about 30% by volume of bodies 10 for each unit volume of chamber and preferably in a ratio of from about 0.06:1 to about 6:1 weight of the bodies 10 to weight of fabric provided to the tumbling chamber. It should be understood by one skilled in the art that the range of ratios of weight of bodies to weight of fabric may be expanded depending upon the type of material from which the bodies 10 are formed.

A body 10 is characterized by protrusions 14 formed from the same material as the body 10 which are spaced across the external surface 12 of the body 10. The protrusions 14 extend outward from the external surface 12 of the body 10.

The face 16 of a protrusion 14 is preferably generally circular; however, the face 16 may have other configurations such as square, rectangular, triangular, elliptical or the like. The protrusions 14 are generally not uniform in appearance and may be irregular in size and shape across the surface 12 of the body 10 as shown in FIG. 1. Non-uniformity of the protrusions 14 may be used to provide various fading effects. For example, use of round shaped protrusions 14 on portions of the bodies 10 and non-round protrusions 14 on other portions of the bodies 10 will provide more instances of oblique angles of collision between a body 10 and the fabric or among bodies 10. By modifying the protrusions 14 to provide varying angles of collision, the present invention results in a multitude of fading effects.

The face 16 of a protrusion 14 is preferably a flat surface roughly resembling the striking face of a small hammer. The preferably flat face 16 is generally parallel to the external surface 12 of the body 10. The face 16 may be curved, partially rounded or of other similar configurations as long as the protrusion 14 is capable of performing a hammering function when tumbled with the fabric in the tumbling chamber and is not configured so as to significantly abrade the fabric or cause significant damage to the chamber. The faces 16 of the protrusions 14 and the external surface 12 of the bodies 10 are preferably generally smooth with, at most, only a slightly roughened texture. The texture may wear from continued use; however, as long as the body 10 and its protrusions 14 remain generally non-abrasive, the bodies 10 are suitable for random fading.

In the most preferred embodiment, the external surface 12 of the body 10 is substantially or more preferably, completely covered with protrusions 14. While protrusion 14 size may vary depending upon the type of random fading effect desired, the protrusions 14 are preferably from about 0.3 mm to about 10 mm, more preferably about 1 mm to about 5 mm in diameter as measured across the face 16 of the protrusion 14 in a direction generally parallel to the external surface 12 of the body 10. The protrusions 14 are spaced an average of from about 1 mm to about 2 mm apart; however, some protrusions 14 may be further than 2 mm and some may be closer than 1 mm or even touching. The height of a protrusion 14 is preferably from about 0.1 mm to about 3.5 mm, more preferably from about 1.0 mm to about 3.5 mm as measured perpendicularly from the external surface 12 of the body 10 to the face 16 of the protrusion 14.

In addition to the bodies 10 and fabric which are provided to the tumbling chamber, a powder (not shown) containing a bleaching agent is provided to the chamber. Preferably the powder is sprinkled within the chamber and not added in a concentrated area of the chamber in order to provide a better dispersion of the bleaching agent throughout the chamber thereby increasing contact of the powder with the fabric and bodies 10. Adding the powder to a concentrated area may tend to hinder even distribution of the powder throughout the chamber.

In addition, concentrating the powder in one area, which is preferably water-soluble, may cause it to clump after contacting the damp or wet fabric. A clump of powder may become trapped in the tumbling fabric causing heavily localized fading in one area of the fabric provided to the chamber while other portions of the fabric remain deprived of powder required for effective random fading. Thus, even distribution of the powder through the chamber is generally preferred to avoid clumping and agglomeration. It is understood by those of ordinary skill in the art that clumping of the powder may be desired in some instances to create a certain effect. In such an instance, providing the powder in a concentrated area of the chamber instead of evenly distributing, or sprinkling, the powder may be desirable.

The bodies 10, the fabric, and the powder may be provided to the chamber in any order without departing from the scope of the invention. It is preferred that the powder be sprinkled on the bodies 10 in the chamber prior to providing damp fabric in order to achieve the best random fading results over the largest surface area of fabric to be faded. Preferably, the fabric should be partially damp so that the powder does not completely stick to the fabric immediately and only partially adheres to the fabric, with some of the powder particles still able to break loose off of the fabric.

In the preferred embodiment, the powder is sprinkled on the bodies 10 prior to adding the damp or wet fabric to the chamber in order to disperse the powder as widely as possible throughout the chamber before the introduction of the moisture from the fabric to the chamber. The damp fabric may cause clumping, premature dissolution or excessive sticking of the powder to the fabric if the fabric is added to the chamber before the powder and/or the bodies 10. Wide dispersion of the powder across the bodies 10 enhances the degree of random fading when the fabric is provided to the chamber as the bodies 10 will be more likely to impact the fabric in an area in which powder is present, then if the powder were concentrated in only a particular section of the chamber as discussed above.

The powder may also be sprinkled on the damp fabric before providing the fabric to the chamber; however, this practice may cause powder to be lost outside the chamber and there may be an increased chance of operator contact with the bleaching agent. Other variations exist for providing the powder, the bodies 10 and the fabric to the chamber in step B, and the above description should not be considered limiting.

The powder is preferably water-soluble so that it may dissolve during contact with the damp or wet fabric in the chamber. The powder preferably includes a bleaching agent, phosphorus, sodium dihydrogen phosphate, silicon dioxide, sodium chloride and other inert ingredients, fillers and binders of the type typically added in bleaching powders and known to those of ordinary skill in the art. The bleaching agent may be any fabric bleach known to those of ordinary skill in the art, including sodium hypochlorite, potassium permanganate, sodium chlorite, potassium persulfate, sodium persulfate, ammonium persulfate, sodium hyposulfite and other similar substances as well as mixtures of these compounds. Preferably, the bleaching agent is potassium permanganate.

The powder 24 is preferably from about 1% to about 10% by weight, and more preferably from about 4% to about 8% by weight, bleaching agent. The remainder of the components of the powder are present in the amounts of from about 5% to about 15% by weight phosphorus, from about 8% to about 14% by weight sodium dihydrogen phosphate, from about 12% to about 25% by weight silicon dioxide and from about 8% to about 25% sodium chloride, with the remainder including inert ingredients. It should be understood by those of ordinary skill in the art that the preferred composition of bleaching powder suitable for a particular fabric varies depending upon the weight of the fabric and the dye used to give the original finish to the fabric to be faded. Such dyes typically vary in accordance with the fabric manufacturer and the country in which the fabric is manufactured. A preferred commercially available powder suitable for use in the present invention is the FADE'M® bleaching composition available from Diversey Corporation, Chemical Div., Wyandotte, Mich.

The powder should have a size and consistency similar to that of ground pepper. The particles may have varying shapes and preferably have an average width measured in the longest dimension of the particle of approximately from about 0.3 mm to about 1.25 mm. The powder is provided to the chamber in step B in a quantity related to the weight of the fabric which is to be faded in any particular lot. The powder should be provided in a range of ratios of from about 1:3 to about 1:40, preferably from about 1:15 to about 1:25 weight powder to weight of fabric to be faded.

Application of heat during the tumbling step is optional. If no heat is applied during tumbling, the fabric should be tumbled with the powder and bodies 10 for a period of preferably from about 7 to about 30 minutes in order to achieve the effect desired. This time may vary depending upon the quantity of fabric provided to the chamber, the tumbling speed of the particular chamber used and the extent of random fading effect desired.

If heat is applied in the chamber during tumbling step B, the chamber may be heated to a preferred range of temperatures from about 100° F. to about 200° F. for periods of time preferably from about 4 to about 20 minutes. More preferably, the dryer 16 is operated in a temperature range of from about 110° F. to about 160° F. for a period of time of from about 3 to about 5 minutes. The drying temperature and time may be varied outside of the preferred ranges depending upon the type and extent of random fading effect desired without departing from the scope of the present invention. Higher temperatures and longer times would provide a lighter and more extensive fading.

During tumbling, the bodies 10 collide with the fabric, embedding the powder into the fabric such that the bleaching agent reacts with the water in the damp fabric causing a fading effect. The hammering action is imparted by the impact of the protrusions 14 against the fabric. The hammering may be characterized as a generally non-abrasive pummelling action whereby the bodies 10 randomly impact the fabric without substantially tearing or otherwise destroying the surface of the fabric. As the collisions of the bodies 10 with the fabric are random, the fading effect occurs in a random fashion resulting in the desired worn, randomly faded appearance.

After tumbling, the fabric is separated from the bodies 10 in step D. The fabric preferably is removed from the chamber leaving the bodies 10 in the chamber to be reused in subsequent processing according to the present method.

After tumbling, the fabric undergoes various optional "clean-up" steps known to those of ordinary skill in the art by washing the fabric in an industrial washing machine of the type described above. One such step is step E, neutralizing the bleaching agent. Neutralization is accomplished by washing the fabric with water and a neutralizing composition comprising, for example, detergent, oxalic acid, sulfur and as well as inert ingredients. An example of a suitable, preferred neutralizing compound is commercially available as PREVENT® from Diversey Corporation, Chemical Div., Wyandotte, Mich. Neutralization step E should preferably be repeated in one or more washing cycles until the water removed from the rinse cycle is clear.

During or preferably after neutralization step E, further optional clean-up steps F and G, brightening and softening respectively, may be carried out during one or more wash cycles. It is understood by those of ordinary skill in the art that these conventional steps may be performed simultaneously or consecutively. Any brightener or softeners known to those of ordinary in the art may be used. A brightener useful in the present method includes, for example, Opti-Brite®. Similarly, a softener useful in the present method includes, for example, Softee®. Softening is particularly recommended in the present method in order to enhance the worn appearance, as the fabric in this method is not physically abraded as in prior art abrasion stone-washing methods in which the act of deliberate surface abrasion effectively causes a softening of the fabric.

After clean-up is completed, the fabric undergoes final spinning and drying steps H and I respectively. The fabric is spun dry in a spinning machine such as that described above and then placed in a typical industrial dryer. The dryer may be of any type described above with respect to any of the previous steps of the method. The fabric is substantially, preferably completely dried at a temperature of from about 140° F. to about 165° F. for a period of from about 18 to about 30 minutes. The finished randomly faded fabric is then removed from the dryer.

This invention will now be more fully illustrated in accordance with the following non-limiting example.

EXAMPLE 450 lbs of denim fabric in the form of denim jeans are desized by washing the fabric in a 450 lb capacity Washex® washing machine with FADE'M® desizing compound which is provided to the washing machine during the wash cycle. The desized fabric is removed from the washing machine and is spun dry in a 42" extractor-type spinning machine to remove excess water. After spinning, the fabric is placed in a 200 lb capacity Melnor® industrial dryer where it is dryed to a damp condition such that the fabric comprises approximately 15% water. The dryer is operated at 150° F. for a period of 15 minutes.

25 lbs of spherical hammering bodies are provided to the rotating drum of a converted industrial dryer which houses the tumbling chamber. The dryer is converted by providing a tumbling chamber having no holes to prevent the loss of water and chemicals in place of the existing drum of the dryer. The chamber has a capacity of 450 lb and a drum rotation speed of 30 rpm.

The bodies have an average diameter of approximately 3.5 cm. The bodies are formed from polyvinyl chloride. The protrusions on the bodies primarily have a generally round, flat face with an average face diameter of 3 mm and an average protrusion height of 1 mm. The protrusions are an average of about 1.5 mm apart.

Analogizing the spheres to a globe, the faces of the protrusions appear more circular in shape at the top and bottom of a spherical hammering body. At the top and bottom, the protrusions extend outward from the external surface of the sphere at an angle of approximately 90° with the surface of the sphere. Moving from the top and/or bottom along the external surface of the sphere to a center or "equator" of the sphere, the protrusions are somewhat more irregularly shaped and form oblique angles with the external surface such that the protrusions appear as elongated lumps with a flat face measuring an average of about 3 mm in the most narrow dimension to about 8 mm in the widest dimension.

After providing the bodies to the dryer, approximately 3 liters of FADE'M® bleaching powder is measured and is sprinkled from a container by hand over the bodies in the drum. The damp fabric is then provided to the drum.

The fabric is tumbled with the bodies and powder without heat for approximately 20 minutes. The tumbling is terminated and the fabric is separated from the bodies by removing the fabric from the drum of the dryer.

The fabric is placed in a Melnor® 450 lb capacity industrial washing machine. After the water reaches its full level in the machine, during the rinse cycle, approximately 2.5 lbs of PREVENT® neutralizing composition is added to the machine. The fabric is then washed in 3 wash cycles until the rinse water appears clear.

The fabric is then washed in a further wash cycle in which approximately 3 lbs of Opti-Brite® and 3 lbs of Softee® are added to the final rinse cycle of the washing machine. The wet fabric is removed from the washing machine and is spun dry in a 42" extractor spinning machine to remove excess water. The damp fabric is then placed in a Braun® 250 lb capacity dryer and is tumbled dry at 150° F. for approximately 30 minutes.

The resulting jeans are randomly faded to a predetermined shade. No sand or powder remains in the seams or pockets of the jeans. In addition, while soft due to the softeners, the surface of the denim is not abraded or otherwise destroyed.

It should be understood by one of ordinary skill in the art that the order of the providing the powder, the fabric and the bodies 10 to the chamber may be changed as long as they are tumbled simultaneously. Similarly, the time between steps of the process is not significant to obtaining a satisfactory result. For example, if the damp fabric dries out before proceeding to the tumbling step, it may be redampened by rinsing in a washing machine. In addition, the optional steps described above may be omitted or altered without affecting the novelty of the tumbling process herein described. Further, differing variations of the shape, weight and size of the bodies 10 as well as the protrusions 14 on the bodies 10 are also within the scope of the invention as long as the bodies 10 effectively hammer the powder into the fabric without significantly abrading the fabric.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. A method for randomly fading fabric, comprising:

(a) providing to a tumbling chamber an at least partially wet fabric to be faded, at least one hammering body having an external surface, the external surface having a plurality of protrusions, and a powder, the powder comprising a bleaching agent, wherein the body has a diameter of from about 1 cm to about 8 cm;

(b) tumbling the fabric, the hammering body and the powder in the chamber such that the protrusions of the hammering body repeatedly strike the fabric, thereby driving the powder into the fabric until a fading effect is achieved, wherein the body is configured for resisting abrasion to the fabric; and (c) separating the faded fabric from the hammering body.

2. The method according to claim 1, further comprising the step of desizing the fabric prior to tumbling the fabric by washing the fabric in an aqueous solution to remove sizing material present in the fabric, the aqueous solution comprising a desizing agent.

3. The method according to claim 1, further comprising the step of washing the faded fabric in water in at least one wash cycle after tumbling.

4. The method according to claim 3, further comprising the steps of spinning and drying the faded fabric after washing the fabric to remove any of the water retained in the fabric.

5. The method according to claim 1, wherein the powder is provided in a range of ratios of from about 1:3 to about 1:40 weight of powder to weight of fabric.

6. The method according to claim 3, wherein the bleaching agent is neutralized by providing a neutralizer to at least one wash cycle.

7. The method according to claim 6, wherein the neutralizer comprises at least one selected from the group consisting of detergent, oxalic acid and sulfur.

8. The method according to claim 3, wherein a brightener is provided to at least one wash cycle.

9. The method according to claim 3, wherein a softener is provided to at least one wash cycle.

10. The method of claim 1, wherein the tumbling chamber is non-porous to retain the powder within the chamber during tumbling.

11. The method according to claim 1 wherein the body is generally spherical and the protrusions are spaced apart and provided throughout the external surface of the body.

12. The method according to claim 1, wherein each of the protrusions has a diameter of from about 0.3 mm to about 10 mm, the diameter measured across a face of the protrusion.

13. The method according to claim 1, wherein the protrusions have a height of from about 0.1 mm to about 3.5 mm, the height measured substantially perpendicularly to the external surface.

14. The method according to claim 1, wherein the bleaching agent is selected from the group consisting of sodium hypochlorite, potassium permanganate, sodium chlorite, potassium persulfate, sodium persulfate, ammonium persulfate and sodium hyposulfite.

15. A method for randomly fading fabric, comprising:

(a) providing to a tumbling chamber an at least partially wet fabric to be faded, at least one hammering body having an external surface, the external surface having a plurality of protrusions, and a powder, the powder comprising a bleaching agent, wherein the body comprises a polymeric material selected from the group consisting of polyvinyl chloride and polyacrylate;

(b) tumbling the fabric, the hammering body and the powder in the chamber such that the protrusions of the hammering body repeatedly strike the fabric, thereby driving the powder into the fabric until a fading effect is achieved, wherein the body is configured for resisting abrasion to the fabric; and (c) separating the faded fabric from the hammering body.

16. A method for randomly fading fabric, comprising:

(a) providing to a tumbling chamber an at least partially wet fabric to be faded, least one hammering body having an external surface, the external surface having a plurality of protrusions and a powder, the powder comprising a bleaching agent, wherein the body comprises a metallic material;

(b) tumbling the fabric, the hammering body and the powder in the chamber such that the protrusions of the hammering body repeatedly strike the fabric, thereby driving the powder into the fabric until a fading effect is achieved, wherein the body is configured for resisting abrasion to the fabric; and (c) separating the faded fabric from the hammering body.

* * * * *